US008535074B2

(12) United States Patent
Hirakawa et al.

(10) Patent No.: US 8,535,074 B2
(45) Date of Patent: Sep. 17, 2013

(54) SWITCH-EQUIPPED COAXIAL CONNECTOR

(75) Inventors: Takeshi Hirakawa, Machida (JP); Kenichi Yotsutani, Machida (JP)

(73) Assignee: Dai-Ichi Seiko Co., Kyoto-shi (JP)

( * ) Notice: Subject to any disclaimer, the term of this patent is extended or adjusted under 35 U.S.C. 154(b) by 0 days.

(21) Appl. No.: 13/455,440

(22) Filed: Apr. 25, 2012

(65) Prior Publication Data

US 2012/0289085 A1 Nov. 15, 2012

(30) Foreign Application Priority Data

May 11, 2011 (JP) ..... 2011-106183

(51) Int. Cl.
*H01R 29/00* (2006.01)

(52) U.S. Cl.
USPC ..... 439/188; 439/63; 439/581

(58) Field of Classification Search
USPC ..... 439/63, 188, 581
See application file for complete search history.

(56) References Cited

U.S. PATENT DOCUMENTS 6,099,334 A * 8/2000 Togashi ..... 439/188
6,761,571 B2 * 7/2004 Hida ..... 439/188
7,726,992 B2 * 6/2010 Wang et al. ..... 439/188
2005/0227523 A1 * 10/2005 Anzai ..... 439/188
2006/0128195 A1 * 6/2006 Chen ..... 439/188
2012/0289084 A1 * 11/2012 Hirakawa ..... 439/578
2012/0289085 A1 * 11/2012 Hirakawa et al. ..... 439/578

FOREIGN PATENT DOCUMENTS

JP 2006-49276 2/2006

OTHER PUBLICATIONS

U.S. Appl. No. 29/405,338, filed Nov. 1, 2011, Hirakawa.
U.S. Appl. No. 29/418,243, filed Apr. 13, 2012, Hirakawa, et al.
U.S. Appl. No. 13/455,404, filed Apr. 25, 2012, Hirakawa.
U.S. Appl. No. 29/429,083, filed Aug. 7, 2012, Hirakawa, et al.

* cited by examiner

*Primary Examiner* — James Harvey
(74) *Attorney, Agent, or Firm* — Oblon, Spivak, McClelland, Maier & Neustadt, L.L.P.

(57) ABSTRACT

Occurrence of defective electrical connection caused by dust that has entered the interior through a corresponding insertion hole can be prevented well by a simple configuration. A through hole facing a corresponding insertion hole is formed to penetrate through a movable contact attached to an insulating housing, and two corresponding connector contact pieces are disposed respectively in both sides sandwiching the through hole. Thus, the dust that has entered the interior through the corresponding insertion hole opened when a corresponding connector is not mated is configured to be discharged through the through hole without accumulating the dust on the movable contact to reduce the risk that the electrical conductivity between the movable contact and the fixed contact may be disturbed by the dust.

7 Claims, 13 Drawing Sheets

Prior Art

SWITCH-EQUIPPED COAXIAL CONNECTOR

BACKGROUND OF THE INVENTION

1. Field of the Invention

The present invention relates to a switch-equipped coaxial connector having a fixed contact and a movable contact, which are caused to be in a mutually separated state when an corresponding connector is mated.

2. Description of the Related Art

Generally, a switch-equipped coaxial connector is used in an electronic device or an electric device such as a mobile phone. The switch-equipped coaxial connector is used as, for example, a small circuit testing switch for testing the state or performance of various electronic circuits such as high-frequency circuits provided in the device. A below-described circuit testing switch according to FIG. 25 and FIG. 26 corresponding to the disclosure of Japanese Patent Application Laid-Open No. 2006-49276 is composed of a switch-equipped coaxial connector 1 mounted on a circuit board so as to separate an electronic circuit of the device main body, and the switch is configured so that a probe (test needle) 2 of a test plug connector serving as a corresponding connector is inserted thereinto from the upper side (the near side in the vertical direction with respect to the paper plane) through a corresponding insertion hole provided in the switch-equipped coaxial connector 1.

In such a switch-equipped coaxial connector 1, an electrically-conductive shell 1*b* for ground connection is attached to outside of an insulating housing 1*a*, and the connector is configured to be mounted and subjected to use when a plurality of board connecting parts 1*c* integrally projecting from the electrically-conductive shell 1*b* are solder-joined with electrically-conductive paths on a wiring board, of which illustration is omitted. A contact pair composed of a movable contact 1*d* and a fixed contact 1*e* for signal transmission is attached to the interior of the insulating housing 1*a* of this case, and the movable contact 1*d* and the fixed contact 1*e* of the pair are respectively connected to one side and the other side of an electronic circuit (illustration omitted) provided on a device main body.

A distal-end part of the probe (test needle) 2 of the test plug connector inserted into the switch-equipped coaxial connector 1 from the upper side (FIG. 26, the near side in the vertical direction of the paper plane) undergoes pressure-contact so as to push-open a free-end part of the movable contact 1*d*, which swings in a substantially horizontal plane; and, as a result, the movable contact 1*d* is swung and separated from the fixed contact 1*e* to separate the original electronic circuit. At the same time, the movable contact 1*d* is brought into contact with a lower-end part of the above described probe 2; and, as a result, the probe 2 becomes the state in which the probe is conducted to another electronic circuit of the device main body. For example, an arbitrary test is configured to be executed when electric signals from the electronic circuit are output to outside through the probe 2.

However, in such a switch-equipped coaxial connector, dust such as garbage easily enters the interior thereof through a corresponding insertion hole provided in an insulating housing. Particularly, the dust may adhere to a movable contact disposed immediately below the corresponding insertion hole, and the dust may enter a part for contact with a fixed contact and cause defective electrical connection.

SUMMARY OF THE INVENTION

Therefore, it is an object of the present invention to provide a switch-equipped coaxial connector configured to be able to well prevent occurrence of defective electrical connection caused by the dust, which has entered the interior through the corresponding insertion hole, by a simple configuration.

In order to achieve the above described object, the present invention is configured so that a switch-equipped coaxial connector has a fixed contact and a movable contact movably provided so as to be in contact/separated with/from the fixed contact, the fixed contact and the movable contact attached to an insulating housing, and the switch-equipped coaxial connector is configured so that the movable contact is separated from the fixed contact by a corresponding connector inserted through a corresponding insertion hole provided in the insulating housing; wherein a through hole is formed in the movable contact so as to face the corresponding insertion hole; and two corresponding connector contact pieces mutually facing via the through hole are provided respectively in both sides sandwiching the through hole so as to form part of the movable contact.

According to the switch-equipped coaxial connector having such a configuration, the dust that enters the interior through the corresponding insertion hole opened when the corresponding connector is not mated is discharged through the through hole without being accumulated on the movable contact. Therefore, the risk that the electrical conductivity between the corresponding connector and the movable contact and the electrical conductivity between the movable contact and the fixed contact may be disturbed by the dust is reduced.

Moreover, it is desirable that the corresponding connector contact piece in the present invention be provided with a contact-point part composed of an inclined surface to be in contact with part of the corresponding connector, the contact-point part provided on a wall surface of the corresponding connector contact piece facing the other corresponding connector contact piece.

According to the switch-equipped coaxial connector having such a configuration, part of the corresponding connector is brought into contact so as to be along the contact-point part composed of the inclined surface of the corresponding connector contact piece. Therefore, good electrical connection is established, and the dust discharged through the through hole is smoothly guided by the inclined surface of the corresponding connector contact piece.

Moreover, it is desirable that the movable contact in the present invention have a support base part fixing the movable contact to the insulating housing and an movable beam extending like a cantilever from the support base part and to be in contact with part of the corresponding connector; and the through hole be provided so as to extend from the movable beam to the support base part.

According to the switch-equipped coaxial connector having such a configuration, the through hole is extending to the support base part of the movable contact. Therefore, the stress generated when a probe of the corresponding connector contacts the movable beam is dispersed without being concentrated at one part of the support base part, and durability of the movable contact is improved.

Moreover, in the present invention, it is desired that the movable contact be provided with two-pronged contact-point parts, part of the two-pronged contact-point parts to be in contact with the fixed contact being divided into two directions; the fixed contact be provided with a projected contact-point part inserted between the two-pronged contact-point parts of the movable contact; and the two-pronged contact-point parts of the movable contact be formed on an inclined surface in contact with the projected contact-point part of the fixed contact.

According to the switch-equipped coaxial connector having such a configuration, the two-pronged contact-point parts of the movable contact are brought into contact so as to be along the projected contact-point part of the fixed contact. Therefore, good electrical connection is established, and the dust which has entered the interior is smoothly discharged by the inclined surfaces of the two-pronged contact-point parts of the movable contact.

Moreover, it is desired that the projected contact-point part of the fixed contact in the present invention be formed into a wedge shape in contact with the two-pronged contact-point parts of the movable contact so as to push and expand the interval between the two-pronged contact-point parts of the movable contact.

According to the switch-equipped coaxial connector having such a configuration, when the two-pronged contact-point parts of the movable contact is brought into contact with the projected contact-point part of the fixed contact, both of them are brought into good contact with each other in a state in which they are in contact with a pressure, and the interval between the two-pronged contact-point part of the movable contact is pushed and expanded. Therefore, the dust present in the vicinity of the contact-point part easily falls through the interval between the two-pronged contact-point parts. Moreover, when the two-pronged contact-point parts of the movable contact is brought into contact with the projected contact-point part of the fixed contact, the interval between the two-pronged contact-point parts is pushed and expanded, and the projected contact-point part and the two-pronged contact-point part are brought into contact so as to slide in a state in which they are in contact with a pressure. Therefore, an effect of cleaning both of the contact-point parts is exerted.

Moreover, in the present invention, it is desired that the movable beam provided in the movable contact be continuously provided from the support base part of the movable contact via a downward step part; the movable beam of the movable contact be inclined and extending in a direction rising toward a contact-point part of the fixed contact from the downward step part; and the height of the support base part of the movable contact from the wiring board be approximately the same height as a contact insertion opening provided in the insulating housing.

According to the switch-equipped coaxial connector having such a configuration, the dust discharged through the through hole is not moved to the contact-point part side of the fixed contact by an upward inclined surface of the movable beam of the movable contact. Therefore, good electrical connection between the movable contact and the fixed contact is established, the contact insertion opening of the insulating housing is closed by the support base part of the movable contact, and dust is prevented from entering therefrom.

Moreover, in the present invention, it is desired that a projection be provided in the insulating housing and at a position opposed to the corresponding insertion hole and opposed to the through hole of the movable contact.

According to the switch-equipped coaxial connector having such a configuration, the projection provided on the insulating housing works as a stopper of the inserted corresponding connector (probe), the excessive external force applied from the corresponding connector to the movable contact is prevented, and contact reliability is improved.

As described above, in the present invention, a through hole facing a corresponding insertion hole is formed to penetrate through a movable contact attached to an insulating housing, and two corresponding connector contact pieces are disposed respectively in both sides sandwiching the through hole. Thus, the dust that has entered the interior through the corresponding insertion hole opened when a corresponding connector is not mated is discharged through the through hole without accumulating the dust on the movable contact to reduce the risk that the electrical conductivity between the corresponding connector and the movable contact and the electrical conductivity between the movable contact and the fixed contact may be disturbed by the dust. Therefore, occurrence of defective electrical connection caused by the dust which has entered the interior through the corresponding insertion hole can be prevented well by a simple configuration, and the reliability of the switch-equipped coaxial connector can be significantly improved at low cost.

DETAILED DESCRIPTION OF THE PREFERRED EMBODIMENTS

Hereinafter, an embodiment in which a switch-equipped coaxial connector according to the present invention is employed as a circuit testing switch will be explained in detail based on drawings.

[About Overall Structure of Circuit Testing Switch]

Figure 1:
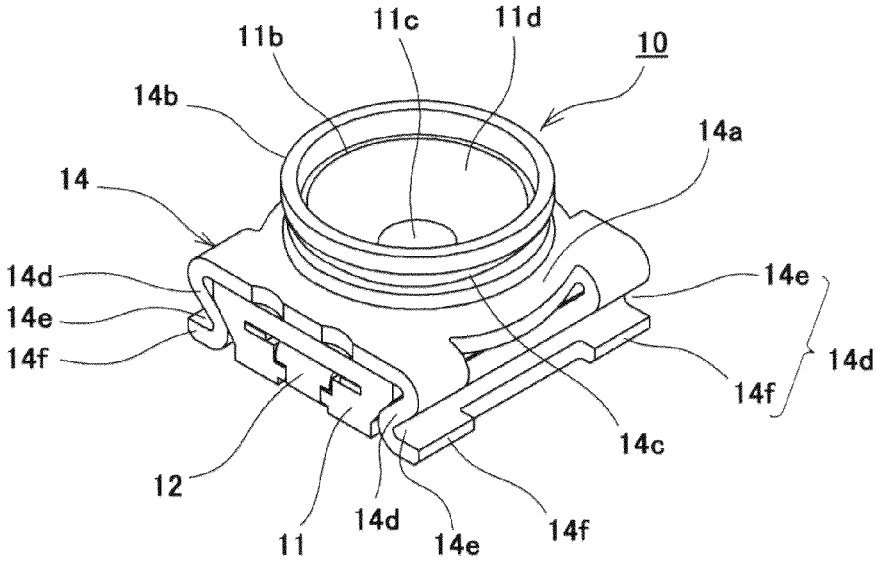
FIG. 1 is an appearance explanatory perspective view showing, from a planar-surface front side, the entire structure of a switch-equipped coaxial connector constituting a circuit testing switch according to an embodiment of the present invention.

First, a switch-equipped coaxial connector 10 according to a first embodiment of the present invention shown in FIG. 1 is mounted on a wiring board, of which illustration is omitted, and a test plug connector 20 (see FIG. 12 and FIG. 13) serving as a corresponding connector is configured to be mated with the switch-equipped coaxial connector 10 from the upper side or removed therefrom toward the upper side. The test plug connector 20 disposed in the upper side of the switch-equipped coaxial connector 10 is pushed toward the lower-side switch-equipped coaxial connector 10 with arbitrary force while being held by a hand of an operator, and, as a result, an attached state in which both of the connectors are mutually mated is obtained. When the test plug connector 20 is held and pulled up to the upper side with arbitrary force in the attached state of the connectors, the test plug connector is detached from the switch-equipped coaxial connector 10 to the upper side, thereby carrying out removal. The insertion/removal of the test plug connector 20 is not limited to that by the hand of an operator, but insertion/removal may be automatically carried out by a machine. Hereinafter, the inserting direction and the removing direction of the test plug connector will be referred to as "downward direction" and "upward direction", respectively.

The switch-equipped coaxial connector 10 constituting an assembly of such a circuit testing switch is subjected to use by, for example, being mounted by soldering onto an electronic circuit board (illustration omitted) provided on an electronic device such as a mobile phone, and the connector is disposed so as to disconnect or connect an electronic circuit provided on the electronic device, for example, from/to the main-body side or antenna side of the device.

[About Configuration of Insulating Housing]

Figure 2:
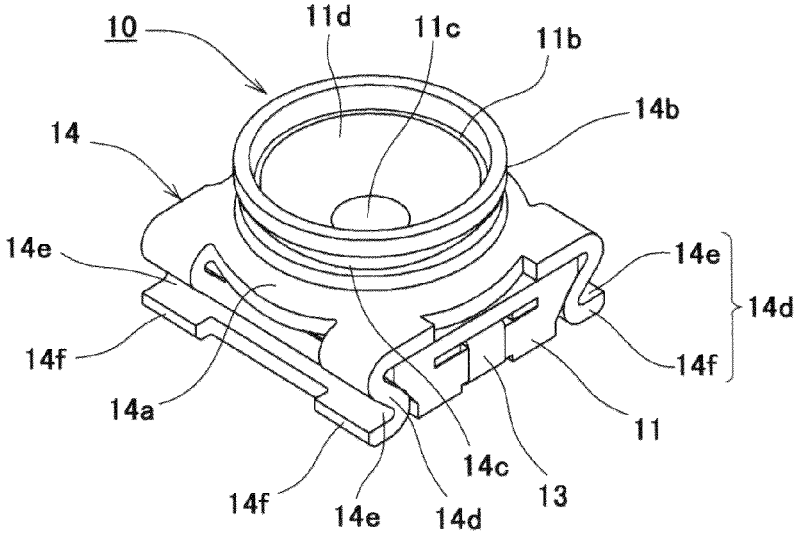
FIG. 2 is an appearance explanatory perspective view showing, from a planar-surface back side, the overall structure of the switch-equipped coaxial connector according to the embodiment of the present invention shown in FIG. 1.
Figure 3:
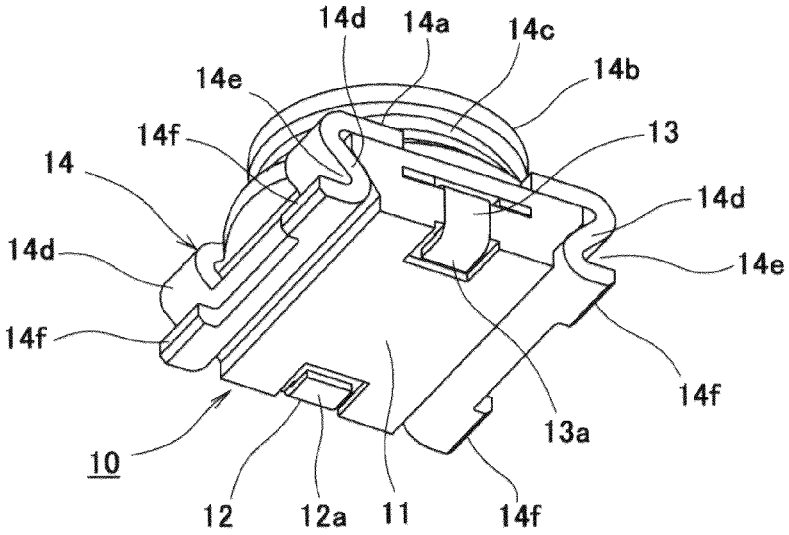
FIG. 3 is an appearance explanatory perspective view showing, from a bottom side, the overall structure of the switch-equipped coaxial connector according to the embodiment of the present invention shown in FIG. 1 and FIG. 2.
Figure 4:
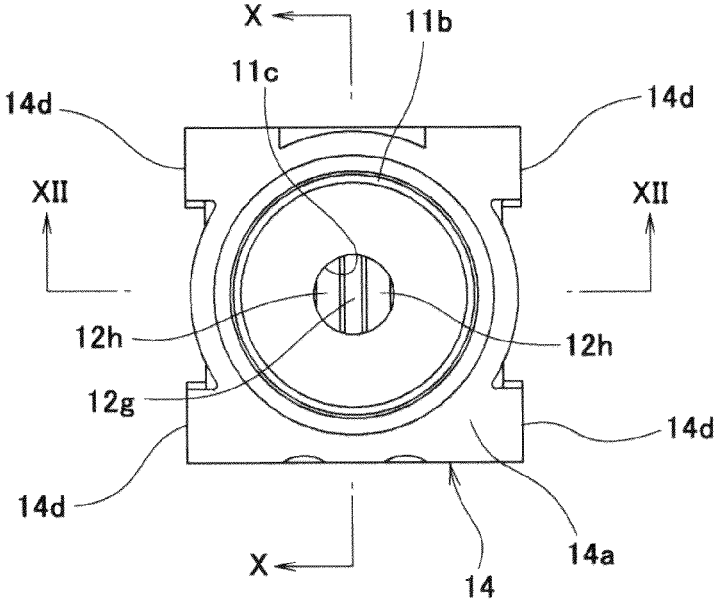
FIG. 4 is an explanatory plan view of the switch-equipped coaxial connector according to the embodiment of the present invention shown in FIG. 1 to FIG. 3.
Figure 5:
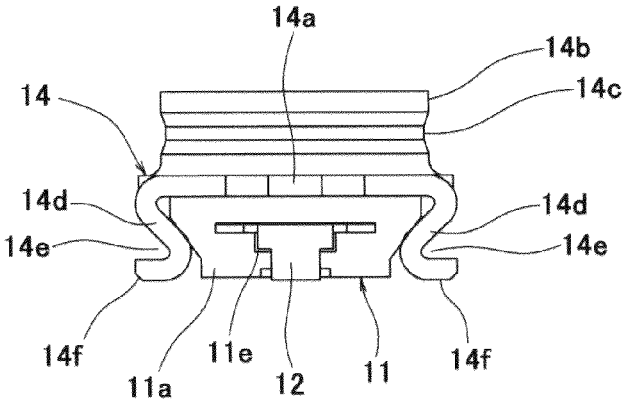
FIG. 5 is a front-side explanatory drawing of the switch-equipped coaxial connector according to the embodiment of the present invention shown in FIG. 1 to FIG. 3.
Figure 6:
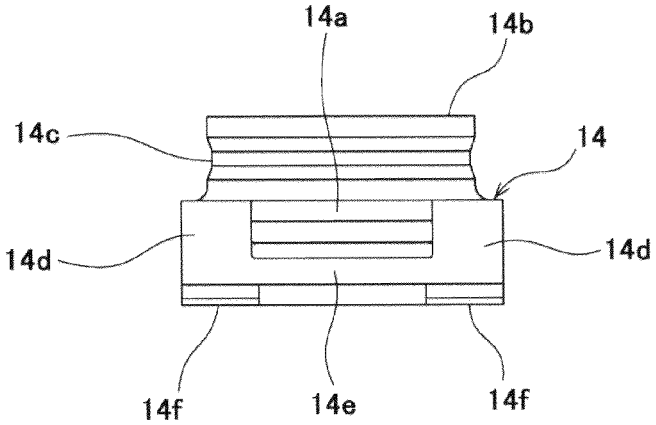
FIG. 6 is a lateral-side explanatory drawing of the switch-equipped coaxial connector according to the embodiment of the present invention shown in FIG. 1 to FIG. 3.
Figure 7:
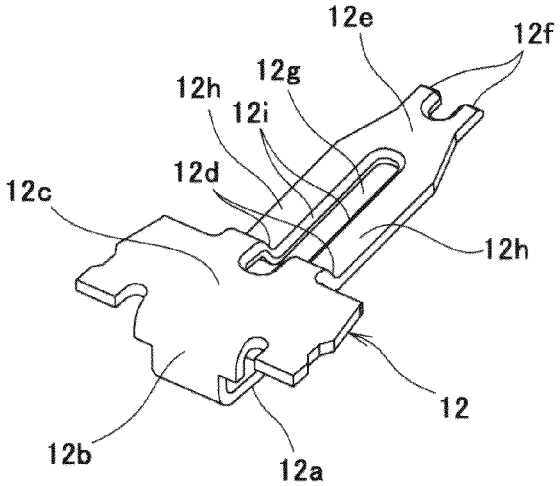
FIG. 7 is an appearance explanatory perspective view showing, from the planar-surface front side, a movable contact used in the switch-equipped coaxial connector according to the embodiment of the present invention shown in FIG. 1 to FIG. 6.
Figure 8:
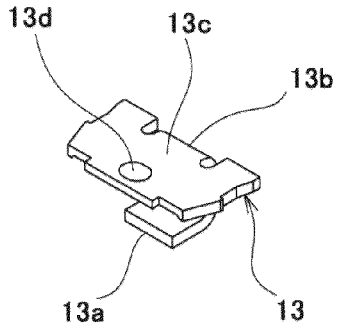
FIG. 8 is an appearance explanatory perspective view showing, from the planar-surface front side, a fixed contact used in the switch-equipped coaxial connector according to the embodiment of the present invention shown in FIG. 1 to FIG. 6.
Figure 9:
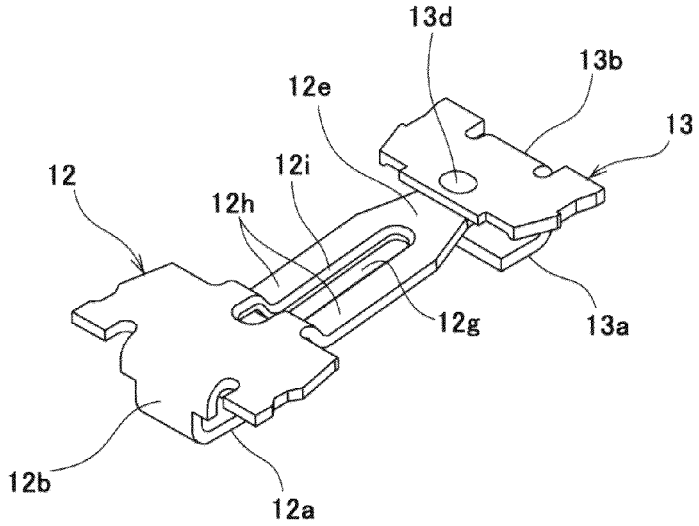
FIG. 9 is an appearance explanatory perspective view showing, from the planar-surface front side, a layout relation of the movable contact and the fixed contact used in the switch-equipped coaxial connector according to the embodiment of the present invention shown in FIG. 1 to FIG. 6.

As also shown in FIG. 2, FIG. 3, and FIG. 4, an insulating housing 11 constituting a main-body part of the switch-equipped coaxial connector 10 is, for example, formed by molding using a resin material such as plastic. The insulating housing integrally has a base frame part 11*a* composed of a plate-like member, which is substantially rectangular in a plane thereof, and an insertion guide part 11*b*, which is disposed at a center part of an upper surface of the base frame part 11*a*.

The insertion guide part 11*b* forms a substantially cylindrical shape from an upper surface of the above described base frame part 11*a* and is formed so as to rise upward therefrom. The inner-periphery-side surface of the insertion guide part 11*b* is formed to have a substantially bowl-like shape. An inclined guide surface 11*d* extending obliquely downward from a circular outer edge part, which is formed at an upper edge part of the insertion guide part 11*b*, toward an upper-surface-side opening of a probe insertion hole 11*c*, which is provided as a corresponding insertion hole at a center part, is formed. The inclined guide surface 11*d* has a function of guiding a probe 20*a*, which is provided in the above described test plug connector 20, toward the probe insertion hole 11*c*. Even when the probe 20*a* of the test plug connector 20 is not disposed immediately above the probe insertion hole 11*c*, as long as a distal-end part of the probe abuts on the inclined surface of the inclined guide surface 11*d*, the distal-end part of the probe 20*a* is configured to be moved so as to slip downward along the inclined guide surface 11*d* and smoothly guided to the probe insertion hole 11*c*.

The probe insertion hole 11*c*, which is provided as the corresponding insertion hole, is extending downward along the central axis of the base frame part 11*a* from the upper-end opening of the insertion guide part 11*b* as described above, and the probe insertion hole 11*c* is formed so as to penetrate up to contact insertion openings 11*e* and 11*f*, which are provided in front/back both end surfaces of the insulating housing 11, and form an opening at a position above a movable contact 12, which will be described later. The probe insertion hole 11*c* is formed so as to form a substantially circular shape in a plane thereof, wherein the circular shape has an inner diameter that allows insertion of the probe 20*a* of the test plug connector 20; and the insertion hole 11*c* is disposed so that the insertion guide part 11*b* is substantially concentric around the upper-surface-side opening of the probe insertion hole 11*c*.

[About Configuration of Contact]

On the other hand, the movable contact 12 and a fixed contact 13 for signal transmission are attached in the base frame part 11*a* of the insulating housing 11 so as to be opposed to each other in a horizontal direction substantially orthogonal to the inserting/removing direction (vertical direction) of the above described test plug connector 20. The movable contact 12 and the fixed contact 13 constitute a so-called contact pair. The contact 12 and the contact 13 are inserted in the insulating housing 11 through the contact insertion openings 11*e* and 11*f*, which are provided in the front/back both end surfaces of the insulating housing 11, and both of the contacts 12 and 13 are attached to the insulating housing 11 so as to be in the state in which the contacts are elastically contacting with each other. The contact state of both of the contacts 12 and 13 is cancelled by mating of the test plug connector 20 as described later to obtain a divided state.

The movable contact 12 and the fixed contact 13 respectively have board connecting parts 12*a* and 13*a* at rear end parts in the direction in which both of the members 12 and 13 are opposed to each other. The board connecting parts 12*a* and 13*a* constitute lower end surface parts of support base parts 12*b* and 13*b*, which are fixed to the insulating housing 11 by press-fitting; and the board connecting parts 12*a* and 13*a* are mounted by solder-joint with electrically-conductive paths for signal transmission provided on the above described wiring board. Each of the support base parts 12*b* and 13*b* having such board connecting parts 12*a* and 13*a* is formed to laterally have a substantially "U" shape. Both of the support base parts 12*b* and 13*b* are fixed by press-fitting with respect to the insulating housing 11 so as to be opposed to each other in the horizontal direction.

Figure 10:
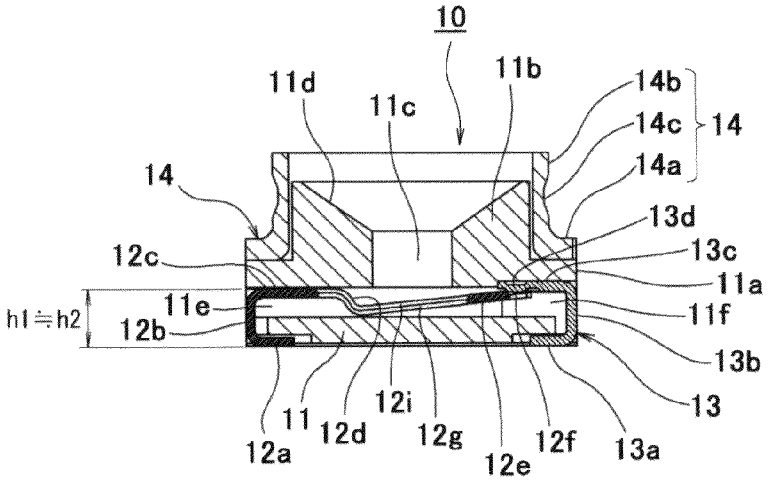
FIG. 10 is a vertical cross-sectional explanatory drawing taken along the line X-X of FIG. 4.
Figure 11:
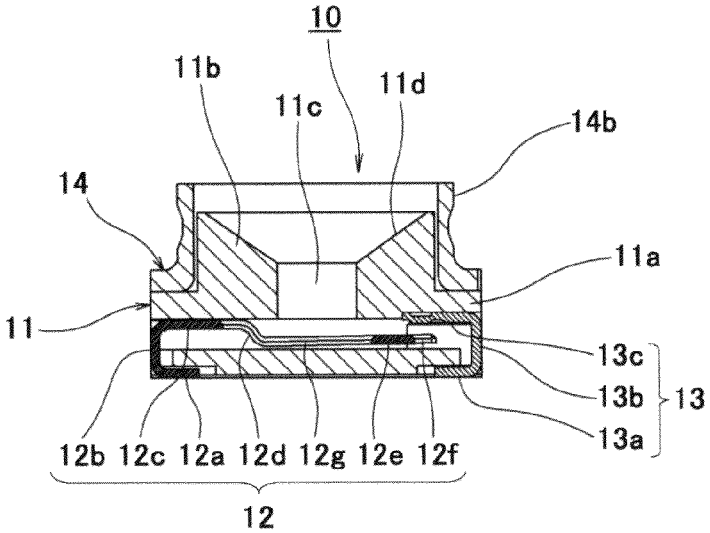
FIG. 11 is a drawing corresponding to FIG. 10 and is a vertical cross-sectional explanatory drawing showing a state in which an illustration-omitted corresponding connector (test plug connector) is inserted.

More specifically, in the support base part 13*b* provided in the fixed contact 13 side, a fixed piece 13*c* constituting an upper end surface part of the support base part 13*b* is provided so as to extend toward the connector inner side (left side of FIG. 10). The fixed piece 13*c* is pressure-joined with an inner wall of the insulating housing 11, and the above described contact insertion opening 11*f* of the insulating housing 11 is closed by the support base part 13*b*. A fixed contact-point part 13*d* substantially-cylindrically projecting downward is formed at a distal-end part of the connector inner side (left side of FIG. 10) of the fixed piece 13*c*.

On the other hand, a fixed piece 12*c* constituting an upper end surface part of the support base part 12*b* provided in the movable contact 12 is also provided to extend toward the connector inner side (right side of FIG. 10). The fixed piece 12*c* is pressure-joined with an inner wall surface of the insulating housing 11 to be in a fixed state, and the above described contact insertion opening 11*e* of the insulating housing 11 is in a closed state because of the support base part 13*b*.

In this manner, in the present embodiment, the support base parts 12*b* and 13*b* provided in the movable contact 12 and the fixed contact 13 have a height h1 from the wiring board, of which illustration is omitted; and the height h1 of the support base parts 12*b* and 13*b* is set so as to be a substantially same height as a height h2 of the contact insertion openings 11*e* and 11*f* provided in the insulating housing (h1≈h2). When such a configuration is employed, the contact insertion openings 11*e* and 11*f* of the insulating housing 11 are closed by the support base parts 12*b* and 13*b* of the movable contact 12 and the fixed contact 13, and entry of dust therefrom is prevented.

In the fixed piece 12*c* provided at the support base part 12*b* of the above described movable contact 12, a downward step part 12*d*, which is formed so as to have a crank shape, is continuously provided so as to form a downward step, and an elastic beam 12*e*, which is extending like a cantilever via the downward step part 12*d*, is continuously provided so as to be swingable in the vertical direction. The downward step part 12*d* constituting a root part of the elastic beam 12*e* is extending obliquely downward from the distal-end part of the fixed piece 12*c* as described above, and a lower-end part of the downward step part 12*e* is disposed so as to abut the inner wall surface provided in the insulating housing 11.

The elastic beam 12*e* extending from the downward step part 12*d* is formed of a belt-like spring member and is disposed so as to be lifted up obliquely upward toward the above described fixed contact 13 side. Movable contact-point parts 12*f* are provided at a distal-end part of the extending side of the elastic beam 12*e*. The movable contact-point parts 12*f* of the movable contact 12 are configured to be brought into elastic contact with, from the lower side, the above described fixed contact-point part 13*d* of the fixed contact 13 by the elastic biasing force of the elastic beam 12*e*.

Figure 12:
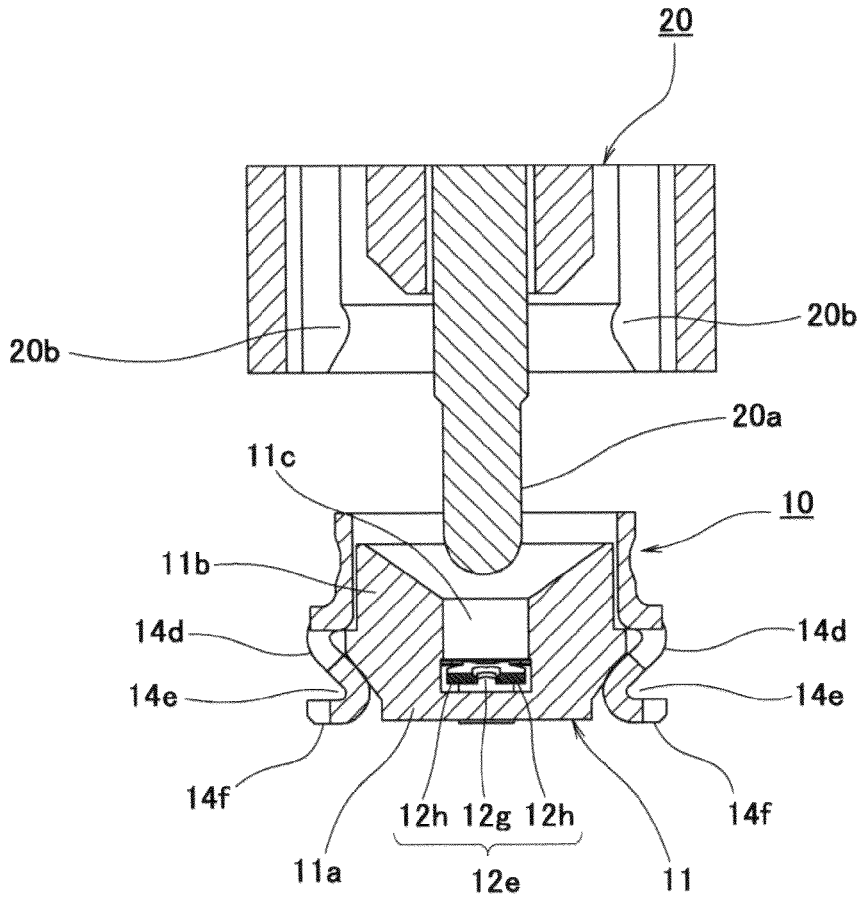
FIG. 12 is a vertical cross-sectional explanatory drawing taken along the line XII-XII of FIG. 4 and a vertical cross-sectional explanatory drawing showing a state immediately before the corresponding connector (test plug connector) is inserted.
Figure 13:
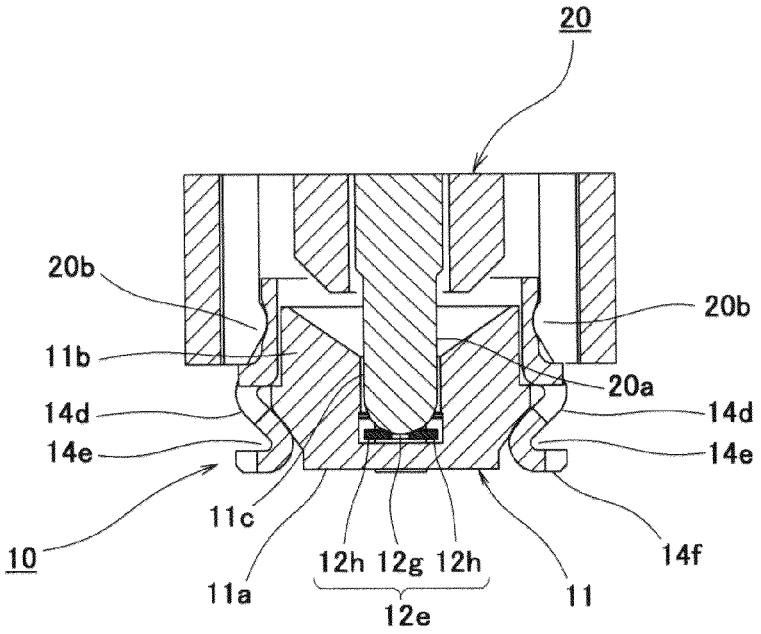
FIG. 13 is a drawing corresponding to FIG. 12 and is a vertical cross-sectional explanatory drawing showing a state in which the corresponding connector (test plug connector) is inserted.
Figure 14:
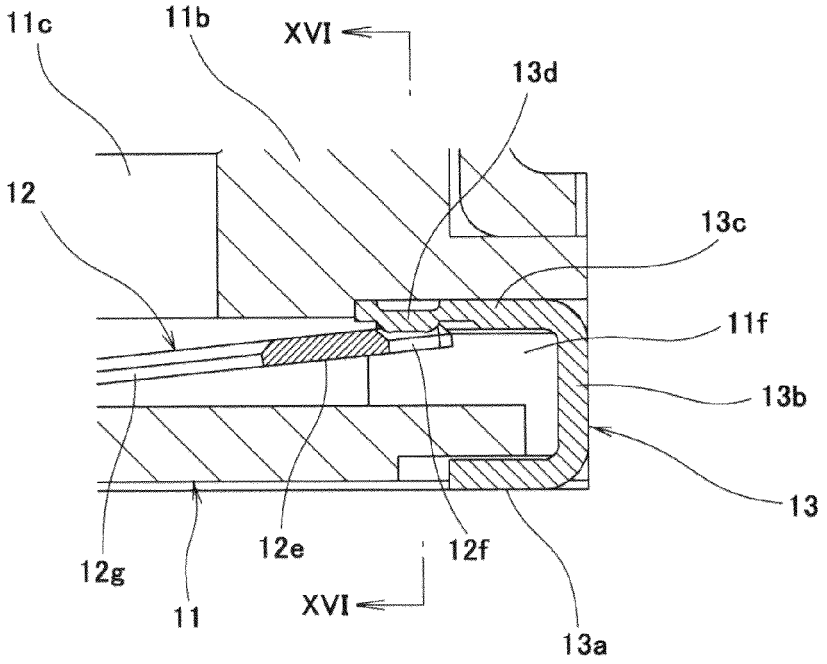
FIG. 14 is a vertical cross-sectional explanatory drawing corresponding to FIG. 10 showing, in an enlarged manner, a state in which the movable contact and the fixed contact are in contact with each other.
Figure 15:
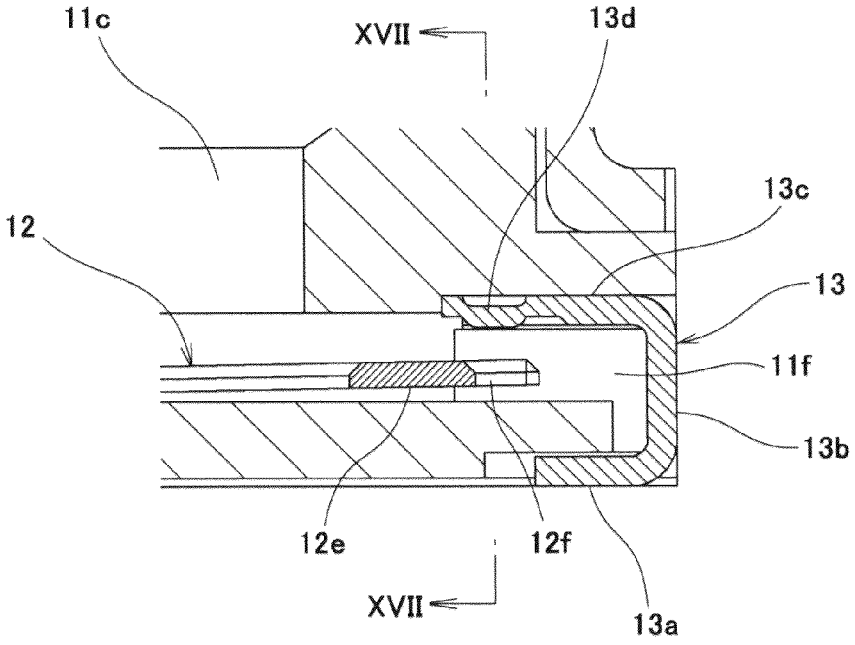
FIG. 15 is a vertical cross-sectional explanatory drawing corresponding to FIG. 10 showing, in an enlarged manner, a state in which the movable contact and the fixed contact are separated from each other.
Figure 16:
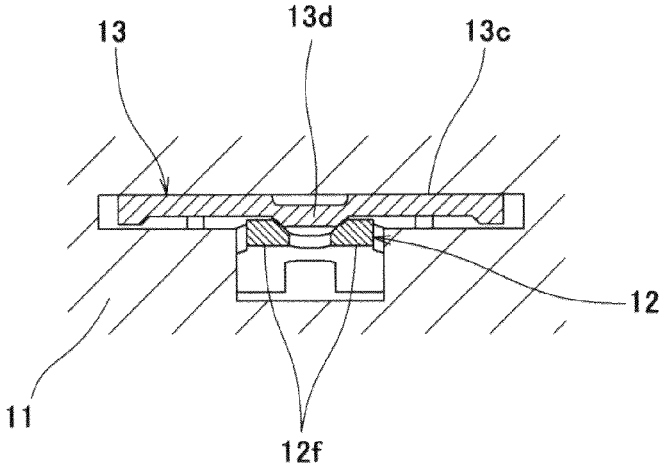
FIG. 16 is a vertical cross-sectional explanatory drawing taken along the line XVI-XVI of FIG. 14.
Figure 17:
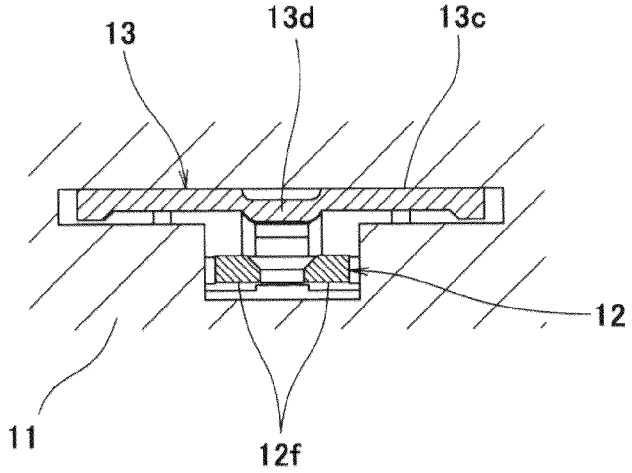
FIG. 17 is a vertical cross-sectional explanatory drawing taken along the line XVII-XVII of FIG. 15.
Figure 18:
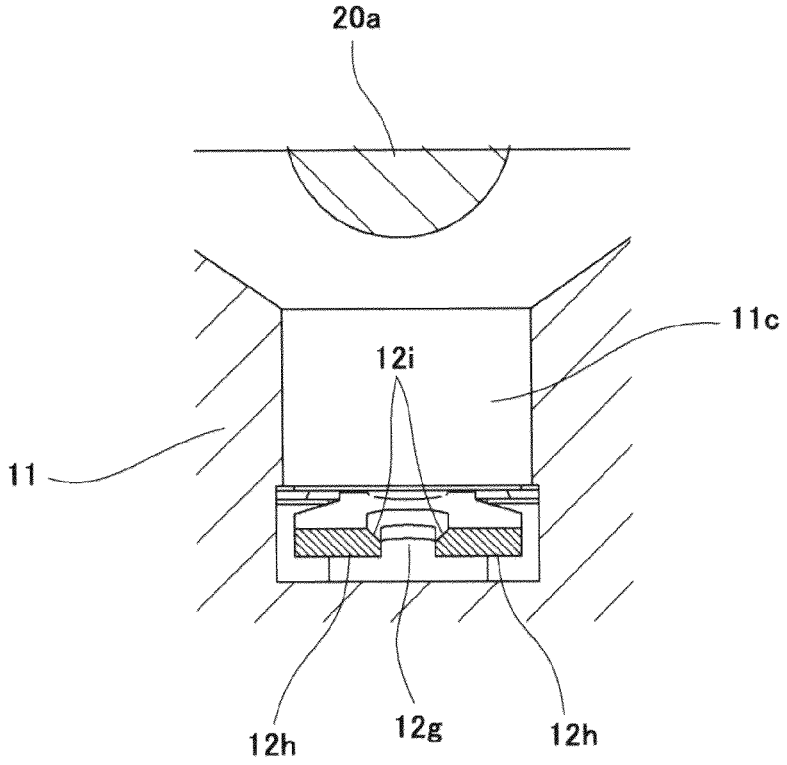
FIG. 18 is a drawing corresponding to FIG. 12 and a vertical cross-sectional explanatory drawing showing, in an enlarged manner, a state immediately before the corresponding connector (test plug connector) is inserted.
Figure 19:
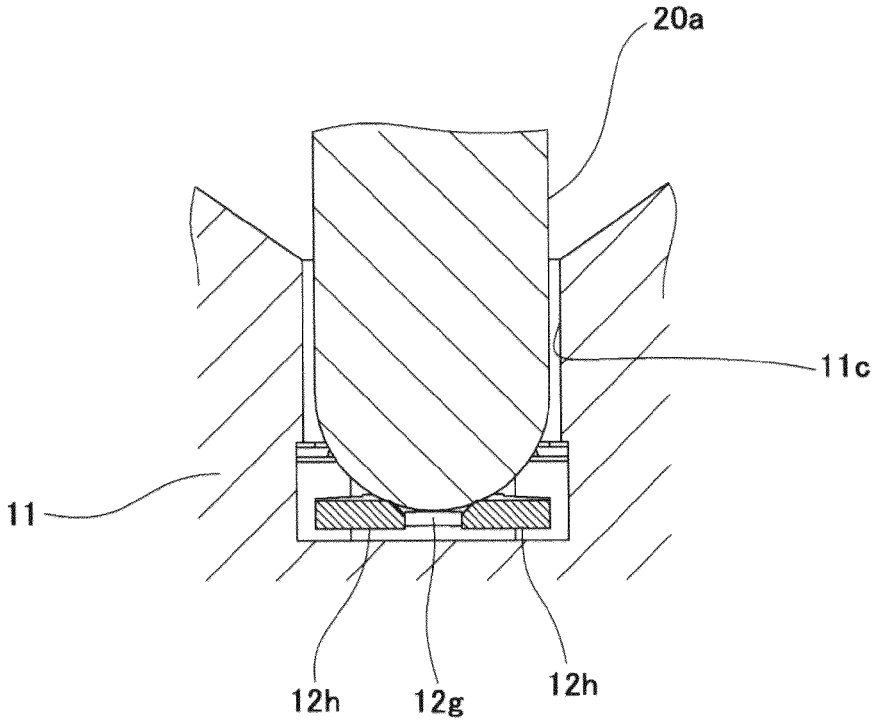
FIG. 19 is a drawing corresponding to FIG. 13 and is a vertical cross-sectional explanatory drawing showing, in an enlarged manner, a state in which the corresponding connector (test plug connector) is inserted.

An extending-direction intermediate part of the belt-like spring member constituting the elastic beam 12*e* of the movable contact 12 as described above is disposed immediately below the above described probe insertion hole 11*c* serving as the corresponding insertion hole. Particularly as shown in FIG. 12 and FIG. 13, when the above described test plug connector 20 is subjected to mating from the upper side so that the probe 20*a* provided in the test plug connector 20 is inserted in the connector through the probe insertion hole 11*c*, the probe 20*a* of the test plug connector 20 abuts the intermediate part of the elastic beam 12*e* of the movable contact 12. Furthermore, when the test plug connector 20 is pushed downward, the movable contact-point parts 12*f* of the movable contact 12 side are separated downward from the fixed contact-point part 13*d* of the fixed contact 13.

The above described movable contact-point parts 12*f* provided in the movable contact 12 side constitute a two-pronged contact-point part divided into two directions at the part contacting the fixed contact-point part 13*d* of the fixed contact, and the movable contact-point parts 12*f* are formed so as to form a substantially U shape in a planar view. With respect to the movable contact-point parts 12*f* of the movable contact 12 side constituting the two-pronged contact-point part, the fixed contact-point part 13*d* provided in the fixed contact 13 side is formed so as to form a substantially-cylindrical projected contact-point part that enters the part between the two-pronged contact-point part of the movable contact 12.

More specifically, the movable contact-point parts 12*f* provided in the movable contact 12 as the two-pronged contact-point parts have an inner peripheral edge formed so as to form a substantially U shape in the plane thereof, and a surface inclined downward toward an inner space part defined by the inner peripheral edge is formed at the inner peripheral edge forming the substantially U shape. The inclined surface provided in the movable contact-point parts 12*f* is configured so as to be in contact, by the surface thereof, with the distal-end part of the fixed contact-point part 13*d* serving as the projected contact-point part of the fixed contact 13.

When the movable contact-point parts 12*f* serving as the two-pronged contact-point part are provided in the movable contact 12 in this manner, the movable contact-point parts 12*f* of the movable contact 12 is brought into contact with the fixed contact-point part 13*d* so as to be along the fixed contact-point part 13*d* provided in the fixed contact 13 as the projected contact-point part. Therefore, electrical connection is carried out well, and the dust that has entered inside of the connector can be smoothly discharged along the inclined surface provided on the movable contact-point parts (two-pronged contact-point parts) 12*f* of the movable contact 12.

Figure 20:
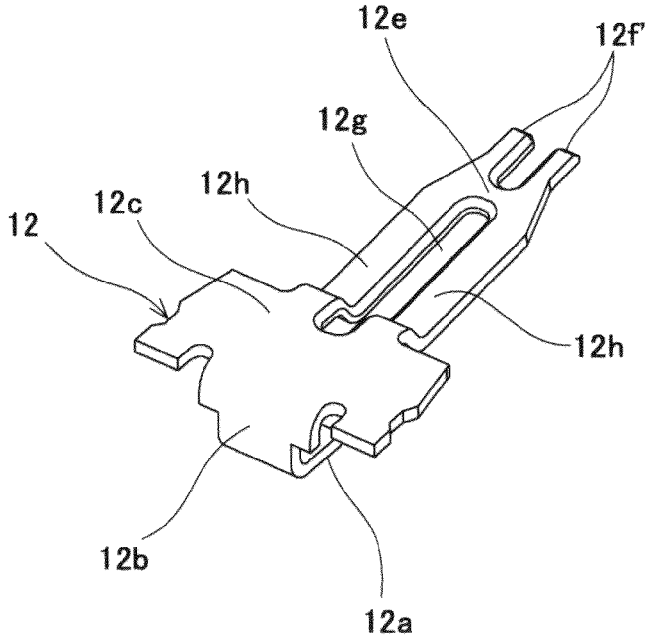
FIG. 20 is an appearance explanatory perspective view showing, from the planar-surface front side, a movable contact according to another embodiment of the present invention.
Figure 21:
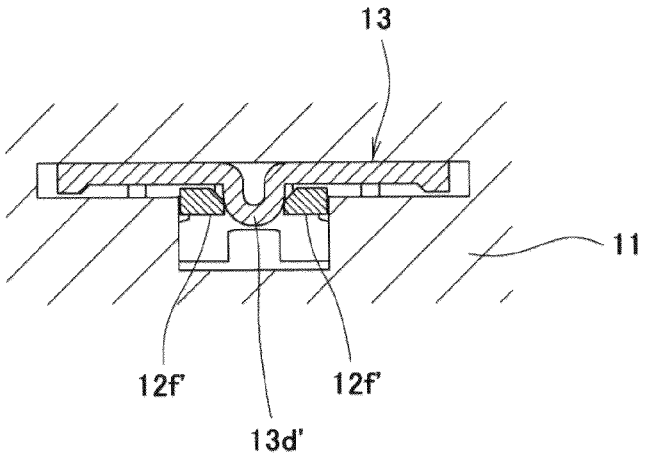
FIG. 21 is a vertical cross-sectional explanatory drawing corresponding to FIG. 16 showing, in an enlarged manner, a state in which the movable contact shown in FIG. 20 is in contact with a fixed contact.
Figure 22:
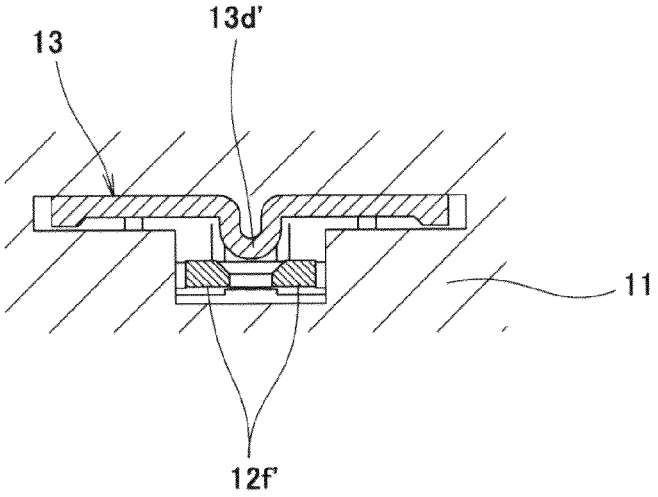
FIG. 22 is a vertical cross-sectional explanatory drawing corresponding to FIG. 17 showing, in an enlarged manner, a state in which the movable contact shown in FIG. 20 is separated from the fixed contact.

In another embodiment according to FIG. 20 to FIG. 22 denoted by the same symbols with respect to the same constituent members as those of the above described embodiment, a two-pronged contact-point part constituting movable contact-point parts 12*f'* provided in the movable contact 12 is formed to have a longer span, and a fixed contact-point part 13*d'* provided as a projected contact-point part in the fixed contact 13 side is provided so as to further project downward and is formed so as to form a wedge shape with respect to the movable contact-point parts (two-pronged contact-point parts) 12*f'* of the movable contact 12 side. When the movable contact-point parts 12*f'* provided in the movable contact 12 are brought into contact with the fixed contact-point part 13*d'* of the fixed contact 13, the fixed contact-point part 13*d'* forming the wedge shape of the fixed contact 13 enters the part between the parts of the two-pronged contact point constituting the movable contact-point parts 12*f'* of the movable contact 12, thereby pushing and expanding the interval between the parts of the two-pronged contact point constituting the movable contact-point parts 12*f'* particularly as shown in FIG. 21.

When such a configuration is employed, when the movable contact-point parts (two-pronged contact-point part) 12*f'* of the movable contact 12 is brought into contact with the fixed contact-point part (projected contact-point part) 13*d'* provided in the fixed contact 13, both of the members 12*f'* and 13*d'* can be brought into contact with each other well in a state that they are joined with a pressure, and the interval between the movable contact-point parts (two-pronged contact-point parts) 12*f'* of the movable contact 12 is pushed and expanded. Therefore, dust such as garbage present in the vicinity of the contact part of both of the members 12*f'* and 13*d'* can easily fall through the expanded interval part of the movable contact-point parts 12*f'* of the movable contact 12. When the movable contact-point parts (two-pronged contact-point part) 12*f'* of the movable contact 12 is brought into contact with the fixed contact-point part (projected contact-point part) 13*d'* provided in the fixed contact 13, the interval between the movable contact-point parts (two-pronged contact-point parts) 12*f'* of the movable contact 12 is expanded by pushing, and the members 12*f'* and 13*d'* are brought into contact with each other so as to slide in the state in which they are in contact with each other in the horizontal direction with a pressure. Therefore, an effect of cleaning the contact-point parts is exerted.

Furthermore, in the belt-like spring member constituting the elastic beam 12*e* of the above described movable contact 12, a through hole 12*g* serving as a dust fall hole is formed so as to form a slit-like shape at the position of contact with the probe 20*a* of the test plug connector 20, in other words, at a position immediately below and opposing the probe insertion hole (corresponding insertion hole) 11*c*. The through hole 12*g* is formed of a narrow-long long hole extending along the longitudinal direction of the movable contact 12, and the through hole 12*g* is extending from the vicinity of the movable contact-point part 12*f* provided in the distal-end side of the above described elastic beam 12*e* to the support base part 12*b* through the position immediately below the probe insertion hole 11*c*.

In the elastic beam 12*e* of the movable contact 12 provided with the through hole 12*g*, two probe contact pieces 12*h* and 12*h* are disposed so as to be extended with narrow widths in the both-side parts sandwiching the through hole 12*g* in the plate width direction of the elastic beam 12*e*. These two probe contact pieces 12*h* and 12*h* constitute corresponding connector contact pieces referred to in the present invention, and the probe contact pieces are disposed so as to define the above described through hole 12*g* and are provided so as to form contact pieces with respect to the probe 20*a* of the test plug connector 20 serving as the corresponding connector.

When the through hole 12*g* is provided in the elastic beam 12*e* of the movable contact 12, dust such as garbage that enters the interior through the probe insertion hole (corresponding insertion hole) 11*c* in an open state when the test plug connector 20 is not mated therewith is discharged through the through hole 12*g* without being accumulated on the movable contact 12 or the fixed contact 13, and, as a result, the risk of disturbing the electric conductivity between the movable contact 12 and the fixed contact 13 is reduced.

In each of the probe contact pieces 12*h* of this case, a test contact-point part 12*i*, which is brought into contact with the probe 20*a* of the test plug connector 20, is provided on the wall surface thereof opposed to the other probe contact piece 12*h* so as to form an inclined surface. The test contact-point part 12*i* is formed so as to extend in a substantially tangential direction with respect to a curved surface formed at a distal-end-side part of the probe 20*a* of the test plug connector 20, and the test contact-point part 12*i* is formed so as to abut the probe 20*a* by the surface thereof.

When the test contact-point parts 12*i* composed of such inclined surfaces are provided on the probe contact pieces 12*h* of the movable contact 12, the distal-end part of the probe 20*a* of the test connector 20 is brought into contact with the movable contact 12 so as to be along the test contact-point parts 12*i* of the probe contact pieces 12*h*, good electric connection between both of the members 12 and 20 is established, and the dust discharged through the through hole 12*g* is smoothly guided by the inclined surface of the probe contact piece 12*h*.

Furthermore, in the present embodiment, the through hole 12*g* provided in the elastic beam 12*e* of the movable contact 12 is extending from the elastic beam 12*e* to the support base part 12*b* side in the rear side as described above, and a rear-end part of the through hole 12*g* is provided to partially extend to the fixed piece 12*c* constituting the upper end surface part of the support base part 12*b*. Therefore, the stress generated when the probe 20*a* of the test connector 20 is brought into contact with the elastic beam 12*e* of the movable contact 12 is dispersed without being concentrated at part of the fixed piece 12*c* of the movable contact 12, so that usage durability of the movable contact 12 is improved.

[About Electrically-Conductive Shell]

On the other hand, an electrically-conductive shell 14 composed of a thin-plate-like electrically-conductive member is attached to the upper-side surface of the above described insulating housing 11 from the upper side so as to cover the surface. The electrically-conductive shell 14 is attached thereto so as to cover part of the outer peripheral surface of the insertion guide part 11*b* from the upper side of the insulating housing 11, and the electrically-conductive shell 14 is formed so that an upper-surface board 14*a* covering the upper-side surface of the insulating housing 11 forms a substantially rectangular shape in the plane thereof.

In a center part of the upper-surface board 14*a* forming a substantially rectangular shape in the electrically-conductive shell 14, a ground terminal part 14*b* covering, from the outer side, the insertion guide part 11*b* of the above described insulating housing 11 is integrally provided so as to form a substantially hollow cylindrical shape. A fixed engagement groove 14*c* forming a circular shape is provided so as to form a recess in the outer peripheral surface of the ground terminal part 14*b*, and an engagement projecting part 20*b* provided on the electrically-conductive shell of the above described test plug connector 20 fits in the fixed engagement groove 14*c*. Thus, the test plug connector 20 is configured to be maintained in the state in which the test plug connector 20 is coupled to the switch-equipped coaxial connector 10 with arbitrary mating force.

Board connecting parts 14*d* extending downward so as to be hung are continuously provided at substantially-rectangular four corner parts of the upper-surface board 14*a* of the above described electrically-conductive shell 14. Among the four board connecting parts 14*d*, two of the board connecting parts 14*d* and 14*d* mutually adjacent in the opposing direction of the above described movable contact 12 and the fixed contact 13 are integrally coupled with each other. The integrally-coupled board connecting parts 14*d* and 14*d* of a first side and the board connecting parts 14*d* and 14*d* of a second side are disposed so as to sandwich the contact pair, which is composed of the movable contact 12 and the fixed contact 13, from both sides. When the board connecting parts 14*d* are solder-joined with ground electrically-conductive paths on the wiring board, of which illustration is omitted, ground connection is established, and the entirety of the switch-equipped coaxial connector 10 is retained.

In this case, the board connecting parts 14*d* are extending downward from the edges of the above described upper-surface board 14*a* so as to form curved shapes. The transverse cross sectional shape of the part 14*d* in the direction orthogonal to the direction in which the two board connecting parts 14*d* and 14*d* are coupled to each other is formed to be curved so as to form a substantially S shape or a substantially Z shape.

The shape of the board connecting part 14*d* provided in the electrically-conductive shell 14 will be explained in detail. The board connecting part 14*d* has a reverse-tapered inclined wall surface extending from the edge of the above described upper-surface board 14*a* toward the inner side of the connector so as to be recessed obliquely downward, and the part 14*d* has a horizontal wall surface projecting again substantially horizontally from the lower-end part of the inclined wall surface toward the outer side of the connector. The reverse-tapered inclined wall surface and the horizontal wall surface provided in the board connecting part 14*d* define a recessed part 14*e* recessed toward the above described fixed contact 13 and the movable contact 12, and the recessed part 14*e* is configured to be provided so as to be recessed in the board connecting part 14*d*. The horizontal wall surface of the above described board connecting part 14*d* is configured to form a solder joint piece 14*f*, which is to be joined onto the wiring board by soldering.

The recessed part 14*e* is configured to be recessed in the board connecting part 14*d* in this manner. As a result, even when an excessive amount of a solder material or flux used for the board connecting part 14*d* of the electrically-conductive shell 14 tries to rise along the board connecting part 14*d* or other wall surfaces of the electrically-conductive shell 14, the excessive amount of the solder material or flux that tries to rise is stored in the recessed part 14*e*. Moreover, the acting force of the rise of the solder material or flux is reduced by the reverse-tapered inclined wall surface constituting the wall surface of the recessed part 14*e*. Furthermore, since the wall surface of the recessed part 14*e* is extending in a curved manner, the rising length of the solder material and flux is extended, the so-called solder-wicking is prevented well, and influence on the electrical conduction state thereof is largely reduced.

Moreover, the board connecting part 14*d* of the electrically-conductive shell 14 according to the present embodiment has the solder joint piece 14*f* extending from the recessed part 14*e* toward the outer side of the connector as described above. Therefore, the joint state of the solder material with respect to the solder joint piece 14*f* of the board connecting part 14*d* can be immediately visually checked by an operator, and working efficiency is improved.

In this case, the distal-end part of the solder joint piece 14*f* according to the present embodiment has the same width-direction size as the upper-surface board 14*a* having the largest outer shape of the above described electrically-conductive shell 14 or positions at somewhat inner side of the connector. By virtue of such a configuration, the overall size can be reduced without causing troubles to the operation of soldering with respect to the solder joint piece 14*f*.

Figure 23:
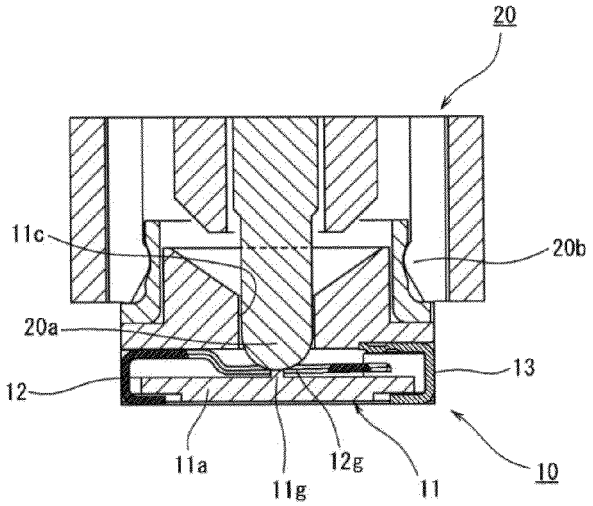
FIG. 23 is a drawing, which shows a switch-equipped coaxial connector according to another embodiment of the present invention and corresponds to FIG. 11, and is an explanatory vertical cross sectional view showing a state in which a corresponding connector (test plug connector) is inserted therein.
Figure 24:
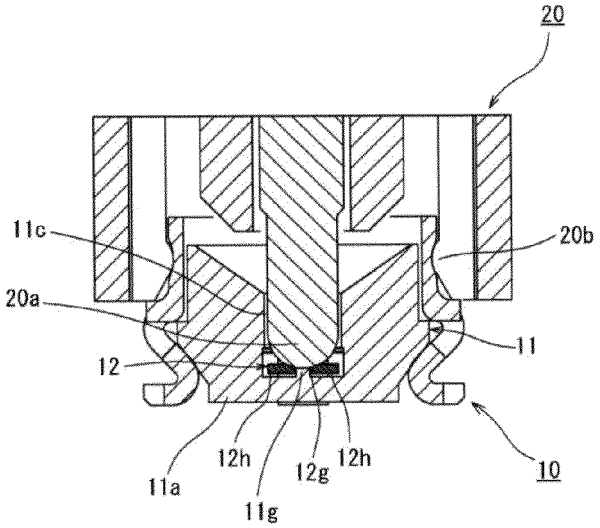
FIG. 24 is a drawing corresponding to FIG. 13 of a switch-equipped coaxial connector according to the embodiment of the present invention shown in FIG. 23 and is an explanatory vertical cross sectional view showing a state in which the corresponding connector (test plug connector) is inserted.
Figure 25:
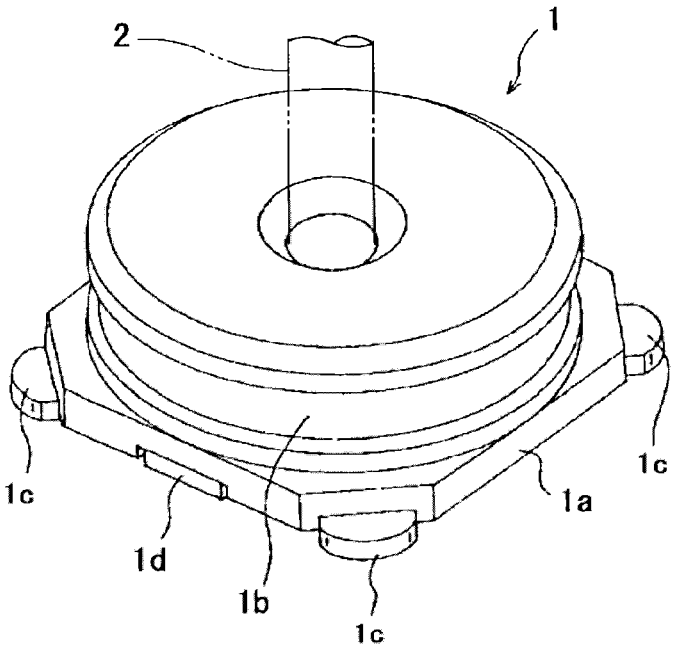
FIG. 25 is a mating perspective explanatory drawing showing an example of a conventional switch-equipped coaxial connector.
Figure 26:
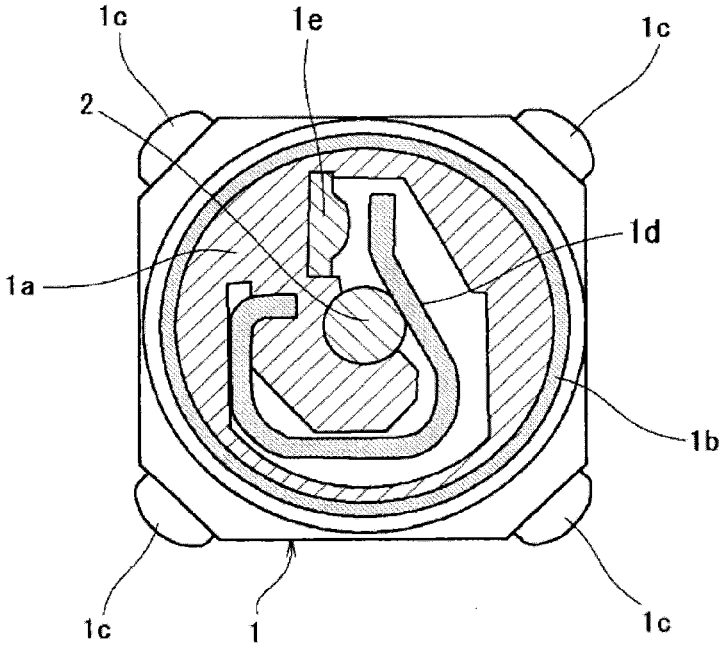
Prior Art Fig. 26
FIG. 26 is a transverse cross-sectional explanatory drawing showing the structure of the conventional switch-equipped coaxial connector shown in FIG. 25.

On the other hand, in a further another embodiment according to FIG. 23 and FIG. 24, wherein the constituent members same as those of the above described embodiment are denoted by the same symbols, a projection 11*g* serving as a movement restricting member (stopper) with respect to the probe 20*a* of the test plug connector (corresponding connector) 20 is provided in the insulating housing 11. The projection 11*g* serving as the movement restricting member is formed so as to project upward from the bottom surface part of the base frame part 11*a* of the insulating housing 11, and the projection is disposed at a position that is opposed to the above described probe insertion hole (corresponding insertion hole) 11*c* and is opposed to the through hole 12*g* of the movable contact 12.

In the case in which such a configuration is employed, when the probe 20*a* of the test plug connector 20 is inserted into the connector through the probe insertion hole 11*c*, the projection 11*g* of the insulating housing 11 works as a stopper of the probe 20*a*, generation of excessive external force applied from the test plug connector (corresponding connector) 20 to the movable contact 12 is prevented, and reliability of contact is improved.

The invention accomplished by the present inventor has been explained in detail above based on the embodiments. However, the present embodiments are not limited to the above described embodiments, and it goes without saying that various modifications can be made within the range not departing from the gist thereof.

For example, in the above described embodiments, the through hole 12*g* is provided in the movable contact 12; however, the through hole may be provided in the fixed contact depending on the overall layout relations.

Moreover, the present invention can be similarly applied also to a switch-equipped coaxial connector used in a use other than the circuit testing switch like that of the above described embodiments.

As described above, the present invention can be widely applied to various switch-equipped coaxial connectors used in various electronic/electric devices.

What is claimed is:

1. A switch-equipped coaxial connector having a fixed contact and a movable contact movably provided so as to be in contact/separated with/from the fixed contact, the fixed contact and the movable contact attached to an insulating housing, the switch-equipped coaxial connector configured so that the movable contact is separated from the fixed contact by a corresponding connector inserted through a corresponding insertion hole provided in the insulating housing; wherein a through hole is formed in the movable contact so as to face the corresponding insertion hole; and two corresponding connector contact pieces mutually facing via the through hole are provided respectively in both sides sandwiching the through hole so as to form part of the movable contact.

2. The switch-equipped coaxial connector according to claim 1, wherein the corresponding connector contact piece is provided with a contact-point part composed of an inclined surface to be in contact with part of the corresponding connector, the contact-point part provided on a wall surface of the corresponding connector contact piece facing the other corresponding connector contact piece.

3. The switch-equipped coaxial connector according to claim 1, wherein the movable contact has a support base part fixing the movable contact to the insulating housing and an elastic beam extending like a cantilever from the support base part and to be in contact with part of the corresponding connector; and the through hole is provided so as to extend from the elastic beam to the support base part.

4. The switch-equipped coaxial connector according to claim 1, wherein the movable contact is provided with two-pronged contact-point parts, part of the two-pronged contact-point parts to be in contact with the fixed contact being divided into two directions;

the fixed contact is provided with a projected contact-point part inserted between the two-pronged contact-point parts of the movable contact; and the two-pronged contact-point parts of the movable contact are formed on an inclined surface in contact with the projected contact-point part of the fixed contact.

5. The switch-equipped coaxial connector according to claim 4, wherein the projected contact-point part of the fixed contact is formed into a wedge shape in contact with the two-pronged contact-point parts of the movable contact so as to push and expand the interval between the two-pronged contact-point parts of the movable contact.

6. The switch-equipped coaxial connector according to claim 3, wherein the elastic beam provided in the movable contact is continuously provided from the support base part of the movable contact via a downward step part;

the elastic beam of the movable contact is inclined and extending in a direction rising toward a contact-point part of the fixed contact from the downward step part; and the height of the support base part of the movable contact from a wiring board is approximately the same height as a contact insertion opening provided in the insulating housing.

7. The switch-equipped coaxial connector according to claim 1, wherein a projection is provided in the insulating housing and at a position opposed to the corresponding insertion hole and opposed to the through hole of the movable contact.

* * * * *

UNITED STATES PATENT AND TRADEMARK OFFICE

CERTIFICATE OF CORRECTION

PATENT NO. : 8,535,074 B2
APPLICATION NO. : 13/455440
DATED : September 17, 2013
INVENTOR(S) : Takeshi Hirakawa et al.

It is certified that error appears in the above-identified patent and that said Letters Patent is hereby corrected as shown below:

On the title page, Item (73), the Assignee information is incorrect. Item (73) should read:

-- (73) Assignee: Dai-ichi Seiko Co., Ltd., Kyoto-shi (JP) --

Signed and Sealed this
First Day of April, 2014

Michelle K. Lee

Michelle K. Lee
*Deputy Director of the United States Patent and Trademark Office*